US007194869B2

(12) United States Patent
McQuiggan et al.

(10) Patent No.: US 7,194,869 B2
(45) Date of Patent: Mar. 27, 2007

(54) TURBINE EXHAUST WATER RECOVERY SYSTEM

(75) Inventors: Gerard McQuiggan, Orlando, FL (US); Gerald A. Myers, Longwood, FL (US); Nitin Chhabra, Orlando, FL (US); Giuseppe Gaio, Bonn (DE)

(73) Assignee: Siemens Power Generation, Inc., Orlando, FL (US)

( * ) Notice: Subject to any disclaimer, the term of this patent is extended or adjusted under 35 U.S.C. 154(b) by 196 days.

(21) Appl. No.: 11/075,680

(22) Filed: Mar. 8, 2005

(65) Prior Publication Data

US 2006/0201131 A1 Sep. 14, 2006

(51) Int. Cl.
*F25B 27/00* (2006.01)

(52) U.S. Cl. ..... 62/238.3; 62/304; 60/39.5; 261/88

(58) Field of Classification Search ..... 62/91–94, 62/238.3, 274, 283, 288, 291, 304; 60/39.5; 261/88; 96/126, 134, 277
See application file for complete search history.

(56) References Cited

U.S. PATENT DOCUMENTS

| | | | | |
|---|---|---|---|---|
| 3,765,168 | A | 10/1973 | Wagle | |
| 3,955,358 | A | 5/1976 | Martz et al. | |
| 4,491,093 | A * | 1/1985 | Hoekstra | 122/420 |
| 4,608,062 | A * | 8/1986 | Hughes | 96/190 |
| 4,973,299 | A * | 11/1990 | Rubin et al. | 494/44 |
| 5,110,457 | A * | 5/1992 | Krawl et al. | 210/787 |
| 5,145,585 | A * | 9/1992 | Coke | 210/695 |
| 5,271,215 | A | 12/1993 | Guillet | |
| 5,491,971 | A | 2/1996 | Tomlinson et al. | |
| 5,643,457 | A * | 7/1997 | Abramov et al. | 210/668 |
| 6,171,718 | B1 * | 1/2001 | Murach et al. | 429/13 |
| 6,446,440 | B1 | 9/2002 | Ranasinghe et al. | |
| 6,449,954 | B2 | 9/2002 | Bachmann | |
| 6,502,402 | B1 | 1/2003 | Smith et al. | |
| 6,526,758 | B2 | 3/2003 | Ranasinghe et al. | |
| 6,637,183 | B2 | 10/2003 | Viteri et al. | |
| 6,675,608 | B2 * | 1/2004 | Inoue et al. | 62/476 |
| 6,739,119 | B2 * | 5/2004 | Erickson | 60/39.53 |
| 2004/0055309 | A1 | 3/2004 | Bellows et al. | |

FOREIGN PATENT DOCUMENTS

| | | | |
|---|---|---|---|
| JP | 63223332 | A | 9/1988 |
| JP | 9-75931 | A * | 3/1997 |
| JP | 2001115856 | A | 4/2001 |
| JP | 2003021301 | A | 1/2003 |

* cited by examiner

*Primary Examiner*—Mohammad M. Ali

(57) ABSTRACT

The exhaust gas of a turbine engine can include water vapor. Aspects of the invention relate to various systems for recovering water from the exhaust gas of a gas turbine engine. In one system, a portion of the exhaust gas can be routed to an absorption chiller. In another system, a portion of the exhaust gas can be routed to a direct contact heat exchanger. In a third system, a portion of the exhaust gas can be routed to a fin-fan cooler. In each of these systems, the portion of gas can be cooled below its dew point temperature to release a portion of its humidity as liquid water. Aspects of the invention can be used with the turbine exhaust of simple and combined cycle power plants. A water recovery system according to aspects of the invention can minimize or eliminate a power plant's dependence on local water sources.

20 Claims, 3 Drawing Sheets

TURBINE EXHAUST WATER RECOVERY SYSTEM

FIELD OF THE INVENTION

The invention relates in general to gas turbine engines and, more particularly, to the exhaust of a gas turbine engine.

BACKGROUND OF THE INVENTION

Water is a scarce resource in certain areas of the world. For power plants located in such areas, there may be an insufficient amount of freely available water to support plant needs. Consequently, power plants have obtained water from other sources, such as rivers or wells. Some power plants have resorted to extracting and desalinizing ocean or brackish water. However, the lack of available water in some areas has dissuaded local decision-makers from building power plants.

The dependence of a power plant on water can restrict the geographic possibilities for power plants to those areas where water is locally available, a permit can be obtained, and/or there is a reduced possibility of intervention from environmental interests. Thus, there is a need for system that can minimize these restrictions and expand the geographic potential for power plant sites irrespective of local water availability.

SUMMARY OF THE INVENTION

Exhaust gas from a turbine engine is usually discharged through an exhaust duct. The turbine exhaust gas has an associated first temperature, and one constituent of the turbine exhaust gas is water vapor. Aspects of the invention relate to systems for recovering water from the turbine exhaust gas.

A first water recovery system according to aspects of the invention includes an absorption chiller. In one embodiment, the absorption chiller can be primarily powered by the heat energy of the exhaust gas in the exhaust duct. A supply conduit extends between and in fluid communication with the exhaust duct and the absorption chiller. The supply conduit receives a portion of the turbine exhaust gas and routes the gas to the absorption chiller. The absorption chiller reduces the temperature of the turbine exhaust gas to less than the dew point of the gas. As a result, at least some of the water vapor in the turbine exhaust gas condenses. The system includes a separator operatively associated with the absorption chiller. The separator removes at least a portion of the condensed water from the exhaust gas.

The system can further include a discharge conduit that is in fluid communication with and extends from the absorption chiller. The discharge conduit can route the gas out of the absorption chiller. The discharge conduit is in fluid communication with the exhaust duct. Thus, the gas can be returned to the exhaust duct. In one embodiment, a blower can be provided along the discharge conduit to facilitate the movement of the gas along the discharge conduit.

The system can further include a heat exchanger. The supply conduit and the discharge conduit can pass in heat exchanging relation through the heat exchanger such that the temperature of the gas in the supply conduit is reduced below the first temperature prior to entering the absorption chiller. Thus, the effective duty of the absorption chiller can be reduced.

A second water recovery system according to aspects of the invention includes a direct contact heat exchanger. The direct contact heat exchanger has an inlet and an outlet as well as an upper end and a lower end. The lower end is defined at least in part by a sump. Both the inlet and the outlet are in fluid communication with the exhaust duct. A portion of the turbine exhaust gas is received in the inlet. In one embodiment, the direct contact heat exchanger can be substantially vertical. In such case, the outlet is provided at a vertically higher elevation than the inlet. A damper can be operatively associated with the outlet of the direct contact heat exchanger. The damper can selectively regulate the flow of the gas through the outlet.

One or more water dispensing devices are provided in the direct contact heat exchanger near the upper end. The water dispensing device is adapted to introduce water into the flow of the turbine exhaust gas. When the water engages the exhaust gas, the temperature of the exhaust gas is reduced below the first temperature so as to condense at least a portion of the water vapor in the exhaust gas. The condensed water collects in the sump.

The system can include a return conduit, which can be in fluid communication with the sump as well as the one or more water dispensing devices. The return conduit can route water from the sump to the one or more water dispensing devices for introduction to the turbine exhaust gas in the direct contact heat exchanger. A pump can be provided along the return conduit to facilitate the flow of water through the return conduit. A heat exchanger can be provided along the return conduit for reducing the temperature of the water to no more than about the ambient dry bulb temperature. The heat exchanger can be, for example, a fin-fan cooler.

The return conduit can include a branch conduit, which can be located upstream of the heat exchanger. Thus, water can flow into the branch conduit for use elsewhere. The branch conduit can be in fluid communication with a storage tank where the water can be stored for later use.

A control valve can be provided along the branch conduit. The control valve can selectively permit and prohibit the flow of the water through the branch conduit. There can also be a sensor for activating and deactivating the valve. The sensor can be connected to the sump and can be responsive to the level of the water in the sump. The sensor can be operatively associated with the control valve such that the sensor activates the control valve when the level of the water in the sump reaches a predetermined level.

A third stack water recovery system includes a separator, a supply conduit and a discharge conduit. The supply conduit extends between and in fluid communication with the exhaust duct and the separator. The supply conduit receives a portion of the turbine exhaust gas and routes the gas to the separator. The discharge conduit extends between and in fluid communication with the separator and the exhaust duct. The gas in the discharge conduit reenters the exhaust duct for release into the atmosphere. In one embodiment, a blower can be provided along the discharge conduit.

The system also includes a first and second heat exchanger. The first heat exchanger is provided along the supply conduit upstream of the separator. The supply conduit and the discharge conduit pass in heat exchanging relation through the first heat exchanger. Thus, the first heat exchanger reduces the temperature of the exhaust gas in the supply conduit below the first temperature. The second heat exchanger, which can be a fin-fan cooler, is provided along the supply conduit downstream of the first heat exchanger and upstream of the separator. The second heat exchanger further reduces the temperature of the turbine exhaust gas to a temperature below the dew point of the gas. Thus, at least some of the water vapor in the turbine exhaust gas can condense, and the separator can removes at least a portion of the condensed water from the gas.

In one embodiment, the system can further include a storage tank. A conduit can extend between and in fluid communication with the separator and the storage tank. Thus, the water can be routed to the storage tank for later use.

DETAILED DESCRIPTION OF EMBODIMENTS OF THE INVENTION

Figure 2:
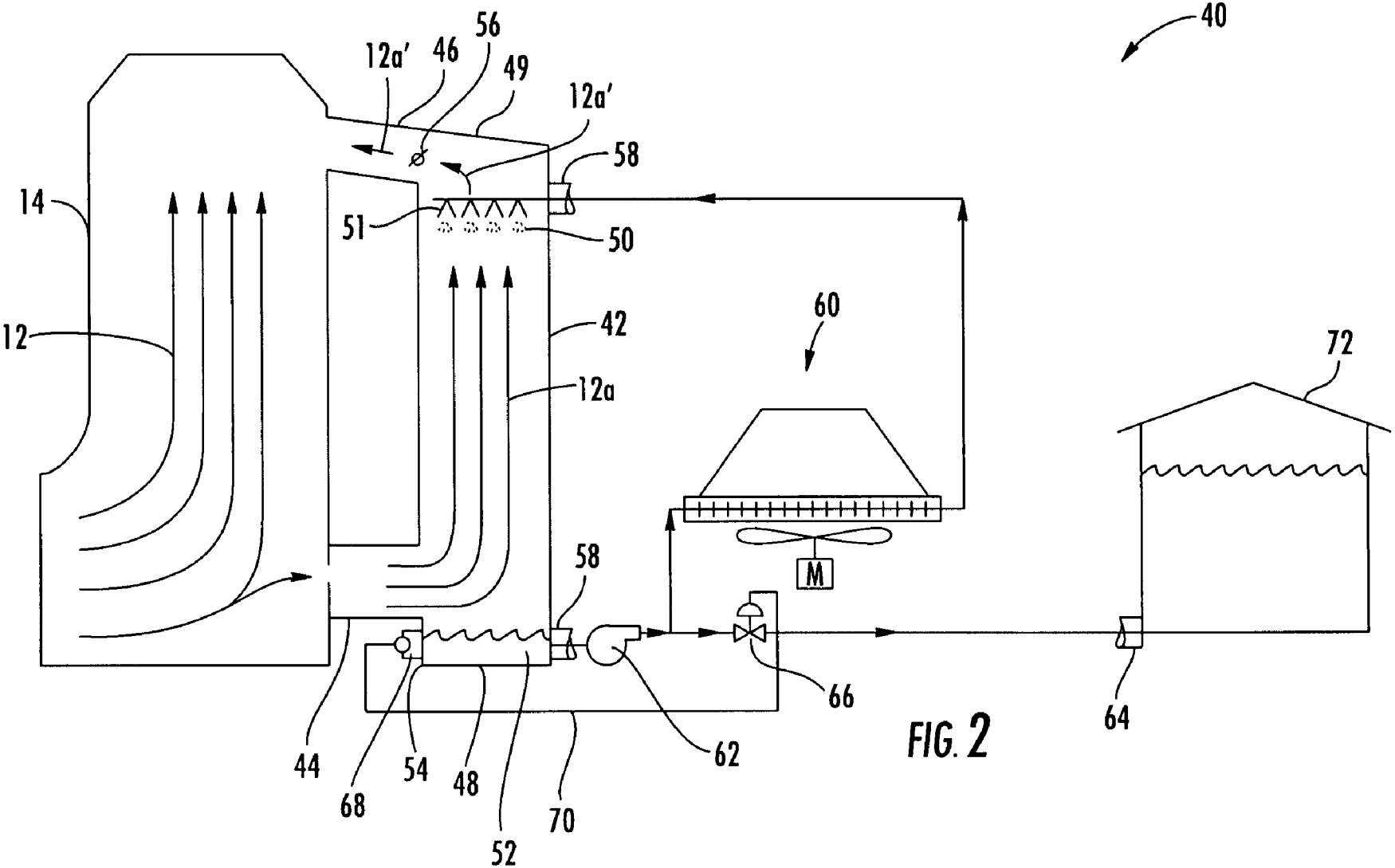
FIG. 2 is a diagrammatic view of a second water recovery system according to aspects of the invention.
Figure 3:
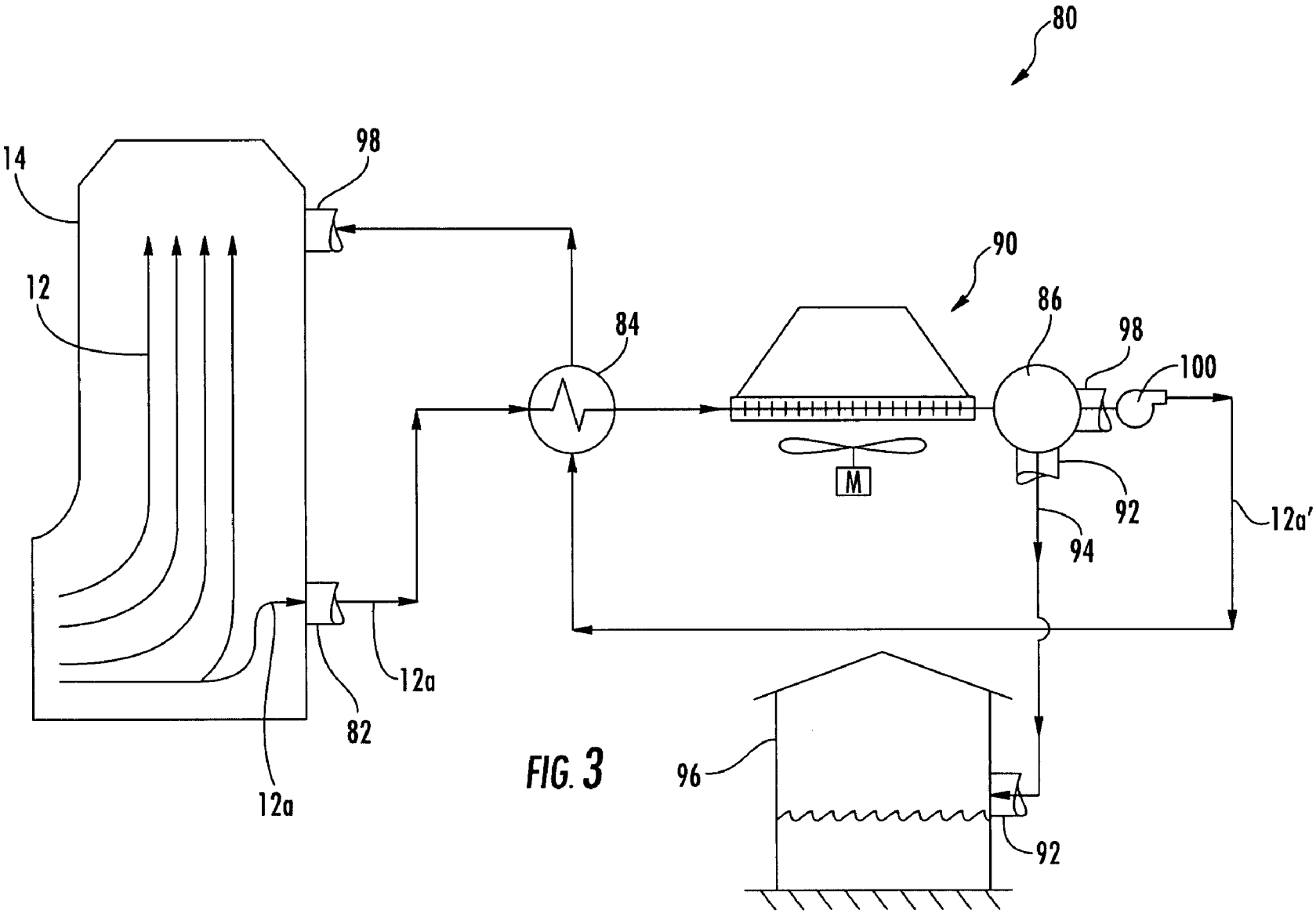
FIG. 3 is a diagrammatic view of a third water recovery system according to aspects of the invention.

Embodiments of the invention present systems for extracting water from turbine exhaust gases. Embodiments of the invention will be explained in the context of various possible systems, but the detailed description is intended only as exemplary. Embodiments of the invention are shown in FIGS. 1–3, but the present invention is not limited to the illustrated structure or application.

In a gas turbine engine, fuel and air can be mixed and combusted to produce high pressure, high velocity gas. The gas can be routed to the turbine section of the engine where energy can be extracted from the gas. After exiting the turbine, the gas can be discharged to the environment through an exhaust stack or other exhaust duct. When a hydrocarbon-based fuel, such as natural gas, is used in the combustion process, one constituent of the combustion gas is water vapor. In one engine system, water vapor can be about five percent of the turbine exhaust mass flow. According to aspects of the invention, this water can be recovered from the exhaust gas for subsequent use, instead of being released to the atmosphere. Embodiments of the invention are particularly suited for extracting water from the exhaust of a turbine in a simple cycle power plant, but aspects of the invention can also be used to extract water from the turbine exhaust in a combined cycle power plant.

Figure 1:
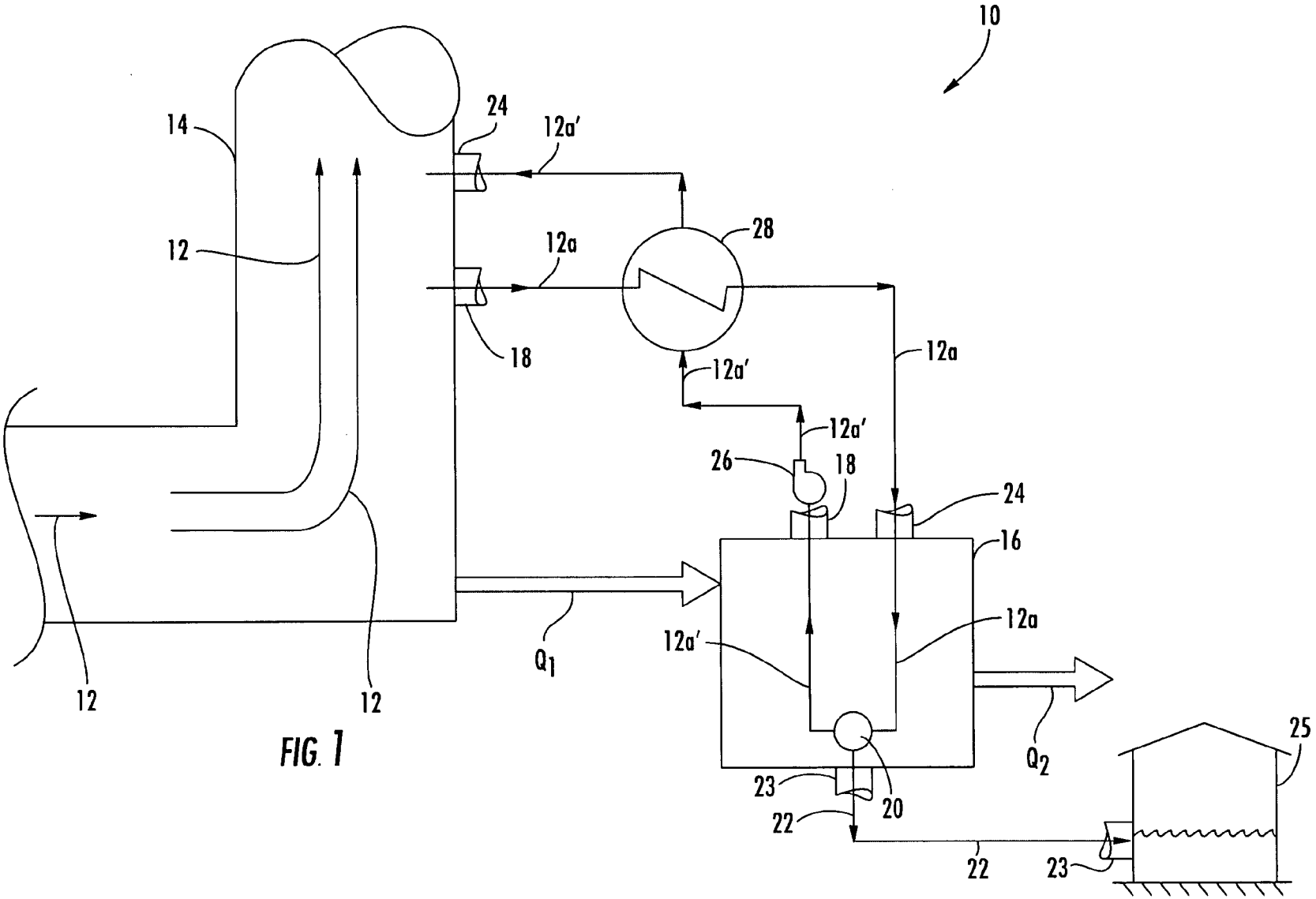
FIG. 1 is a diagrammatic view of a first water recovery system according to aspects of the invention.

One water recovery system 10 according to aspects of the invention is shown in FIG. 1. Exhaust gas 12 from the turbine (not shown) are routed through an exhaust stack or other exhaust duct 14. The exhaust duct 14 can have any of a number of shapes and sizes, and the exhaust duct 14 according to aspects of the invention is not limited in either of these regards. Likewise, the exhaust duct 14 can be made of any of a number of materials. The exhaust duct 14 can be arranged so as to be substantially vertical, but other orientations are possible.

The exhaust duct 14 can be configured to route a portion 12*a* of the exhaust gas 12 to an absorption chiller 16. In one embodiment, a supply conduit 18 can extend between the exhaust duct 14 and the absorption chiller 16 so that the absorption chiller 16 can be in fluid communication with the exhaust duct 14. The supply conduit 18 can be directly or indirectly connected to the exhaust duct 14. Similarly, the supply conduit 18 can be directly or indirectly connected to the absorption chiller 16. The supply conduit 18 can be formed by one or more components including, for example, pipes or ducts.

According to aspects of the invention, the absorption chiller 16 can be used to cool the portion of the exhaust gas 12*a*, as will be explained later. Absorption chillers are generally known, so their manner of operation will not be explained herein. The system 10 can further include a separator 20 to facilitate the removal of liquid water from the portion of exhaust gas 12*a*. The separator 20 can be provided inside of the chiller 16, or it can be provided outside of the chiller 16. There are various methods by which the separator 20 can remove liquid water from the portion of exhaust gas 12*a*. For example, the separator 20 can reduce the velocity of the gas 12*a* flowing through the absorption chiller 16, thereby allowing the force of gravity to settle out the water. Alternatively, the separator 20 can remove liquid water by inertial separation, an agglomerator, or any other suitable method.

Regardless of the particular separation method used, water 22 can be collected and can flow from the absorption chiller 16 and/or the separator 20 to a process user or a storage device. A discharge conduit 23 can be provided to facilitate flow of the water 22 from the absorption chiller 16 and/or the separator 20. In one embodiment, a discharge conduit 23 can be connected, directly or indirectly, at one end to the absorption chiller 16 and/or the separator 20. At an opposite end, the discharge conduit 23 can connect, directly or indirectly, to a storage tank 25. Thus, it will be appreciated that the storage tank 25 can be in fluid communication with the absorption chiller 16 and/or the separator 20. The discharge conduit 23 can be formed by one or more components including, for example, pipes or ducts.

The cooling process of the absorption chiller 16 can be primarily driven by heat energy rather than mechanical energy. Because the exhaust gas 12 can be hot, such as in the range of about 1000 to about 1200 degrees Fahrenheit, the excess heat energy of the exhaust gas 12 can be used to power the absorption chiller 16. As shown in FIG. 1, heat energy Q1 from the exhaust gas 12 in the exhaust duct 14 can be delivered to the absorption chiller 16 to cool the gas 12*a* therein. Heat Q2, which includes at least heat energy Q1 as well as any heat extracted from the gas 12*a*, can be rejected to the atmosphere.

After passing through the absorption chiller 16, the less humid gas 12*a*' can be routed back to the exhaust duct 14. Preferably, the gas 12*a*' reenters the exhaust duct 14 downstream of where the gas 12*a* was initially diverted to the absorption chiller 16, that is, downstream of the supply conduit 18. However, the gas 12*a*' can reenter the exhaust duct 14 at other locations as well. The absorption chiller 16 can be in fluid communication with the exhaust duct 14 by a return conduit 24. The return conduit 24 can extend between the absorption chiller 16 and the exhaust duct 14. The return conduit 24 can be directly or indirectly connected at one end to the exhaust duct 14. Similarly, the return conduit 24 can be directly or indirectly connected at the other end to the absorption chiller 16. The return conduit 24 can be formed by any of a number of components including, for example, one or more pipes, ducts, or fittings. A blower 26 can be provided along the return conduit 24 to facilitate the movement of the gas 12*a*' through the return conduit 24 and toward the exhaust duct 14. Preferably, the blower 26 is located along the return conduit 24 at a point where the gas 12*a*' is coldest, such as near the absorption chiller 16.

While the supply conduit 18 and the return conduit 24 can be isolated from each other, it is preferred if the conduits 18, 24 are configured as to be in heat exchanging relation with each other. For example, the supply and return conduits 18, 24 can pass through a common heat exchanger 28, as shown in FIG. 1. As a result, the temperature of the gas 12*a* in the supply conduit 18 can decrease, and the temperature of the gas 12*a*' returning to the exhaust duct 14 in the discharge conduit 24 can increase. Such an arrangement can be beneficial in that the effective duty of the absorption chiller 16 can be reduced. That is, the gas 12*a* can be initially cooled prior to entering the absorption chiller 16. Thus, it may be possible to employ a less expensive absorption chiller 16. Despite this advantage, a system within the scope of the invention may not need such pre-treatment of the exhaust gas 12*a* prior to its entry into the absorption chiller 16.

One manner in which such the system 10 can be used will now be described. Assuming the exhaust gas 12 is at about 1100 degrees Fahrenheit, the portion of exhaust gas 12*a* can be routed to the absorption chiller 16 through the supply conduit 18. After passing through the heat exchanger 28, the temperature of the gases 12*a* can be reduced to, for example, about 300 degrees Fahrenheit. The chiller 16 can further reduce the temperature of the gas 12*a* to about 150 degrees Fahrenheit or otherwise below the dew point temperature of the gases 12*a* to release a portion of its humidity as liquid water. The separator 20 can be used to remove the liquid water 22 from the gas 12*a*. Again, the water 22 can be sent to storage or can be used for other purposes. The gas 12*a*' exiting the chiller 16 can be at about 150 degrees Fahrenheit. After passing in heat exchanging relation with the gas 12*a* in the supply conduit 18, the temperature of the gas 12*a*' can increase to about 1000 degrees Fahrenheit. The heated dehumidified gas 12*a*' can reenter the duct 14 to be released to the atmosphere. It will be understood that the foregoing description of the operation of the system 10 is provided merely as an example. The temperatures discussed above are provided to facilitate discussion and are not intended to limit the scope of the invention.

Another water recovery system 40 according to aspects of the invention is shown in FIG. 2. Again, the system 40 includes an exhaust duct 14 through which exhaust gas 12 flows. The previous discussion of the exhaust duct 14 applies equally here.

A direct contact heat exchanger 42 can be in fluid communication with the exhaust duct 14. The direct contact heat exchanger 42 can have an inlet 44 and an outlet 46, each of which is in fluid communication with the exhaust duct 14. The heat exchanger can be arranged in various ways. In one embodiment, the direct contact heat exchanger 42 can be a substantially vertically elongated duct. The inlet 44 can be substantially vertically lower than the outlet 46. In one embodiment, the inlet 44 can be located near the vertically lower end 48 of the heat exchanger 42 and/or the exhaust duct 14.

A portion 12*a* of the hot exhaust gas 12 in the exhaust duct 14 can be diverted into the direct contact heat exchanger 42 through the inlet 44. As the gas 12*a* travels through the heat exchanger 42, liquid water can be introduced into the flow path of the gas 12*a*. Liquid water droplets 50 can be sprayed or otherwise injected into the heat exchanger 42. Preferably, the water 50 is introduced near the vertically upper end 49 of the heat exchanger 42. The water 50 can be introduced by a water dispensing device 51, which can be one or more injectors, shower heads, sprayers and/or misters. Ideally, the water 50 is cold, such as at about the ambient dry bulb temperature. The falling cold water droplets 50 can contact and cool the gases 12*a* to a temperature at or below the dew point of the gas 12*a* so as to condense the water vapor out of the gases 12*a*. Water 52, which includes the water droplets 50 and condensed water from the gas 12*a*, can collect in a sump 54 that can form at least a part of the vertical lower end 48 of the heat exchanger 42. The continuing exhaust gas 12*a*' can flow back into the exhaust duct 14 through the outlet 46 where it can mix with the other duct gas 12 and be released to the atmosphere. While the foregoing discussion of the direct contact heat exchanger 42 has been in connection with a substantially vertical duct, the direct contact heat exchanger 42 according to aspects of the invention can have any of a number of configurations. For instance, the direct contact heat exchanger 42 can be a substantially elongated horizontal duct. It will be understood that a wide range of configurations for the direct contact heat exchanger 42 are within the scope of the invention.

A damper 56 can be provided in or near the outlet 46 of the heat exchanger 42 to control the flow of the gas 12*a*' out of the heat exchanger 42, as may be desired based on the local climate or output restrictions. The control damper 56 can be a plate or a valve, such as a butterfly valve. The damper 56 can be any device for controlling the amount of the gas 12*a*' exiting the heat exchanger 42. The operation of the damper 56 can be manual or motorized.

In one embodiment, a portion of the water 52 in the sump 54 can be routed to a conduit 58 for use in the direct contact heat exchanger 42. The conduit 58 can be defined by, for example, pipes, ducts and fittings. A heat exchanger can be provided along the conduit. The heat exchanger can be, for example, a fin-fan cooler 60 and can be used to reduce the temperature of the water 52 flowing through the conduit 58. Preferably, the temperature of the water 52 is reduced to near the ambient dry bulb temperature. A pump 62 can be provided along the conduit 58 to facilitate delivery of the water 52 from the sump 54 to the heat exchanger 42. After exiting the heat exchanger 42, the cooled water 52 can be delivered to the direct contact heat exchanger 42, preferably toward the vertical upper end 49 thereof. The cooled water 52 can be introduced to the portion of exhaust gases 12*a* flowing through the heat exchanger 42 as water droplets 50, as discussed above.

In addition to being reused in the heat exchanger 42, the collected water 52 can be stored or used for other purposes. To that end, the conduit 58 can include a branch conduit 64. A level control valve 66 can be provided along the branch conduit 64 for selectively permitting and prohibiting the flow of water 52 along the branch conduit 64. The operation of the level control valve 66 can be dependent on the level of water 52 in the sump 54. In one embodiment, a level sensor 68 can be connected to the sump 54. The sensor 68 and the valve 66 can be operatively connected in various ways. For instance, the sensor 68 and the valve can be operatively connected by a wire 70. Alternatively, the sensor 68 and the valve 66 can be operatively connected by telemetry or some other remote communication arrangement. The sensor 68 can be responsive to the level of the water 52 in the sump 54. When the water 52 in the sump 54 reaches a first predetermined level, the sensor 68 can generate a signal instructing the valve 66 to open. The valve 66 can remain open for a preset amount of time or until the sensor 68 instructs the valve 66 to close, such as when the water level in the sump 54 drops to a second predetermined level.

When the valve 66 opens, the collected water 52 can flow along the branch conduit 64, which can be facilitated by the pump 62. The branch conduit 64 can route the water 52 to wherever it is needed. In one embodiment, the water 52 can be exported to a storage tank 72 for later use.

A third water recovery system 80 according to aspects of the invention is shown in FIG. 3. Again, there is an exhaust duct 14 with exhaust gas 12 from the turbine (not shown) flowing therethrough. The previous discussion of the exhaust duct 14 applies equally here. A supply conduit 82 can extend from the exhaust duct 14. The supply conduit 82 can be formed by various devices including, for example, pipes, ducts and fittings. A portion or slip stream of the gas 12*a* can enter the supply conduit 82.

Various devices can be provided in series along the supply conduit 82 including, for example, a first heat exchanger 84, a second heat exchanger and a separator 86. The first heat exchanger 84 can be used to decrease the temperature of the portion of gas 12*a* passing therethrough. As will be explained later, the first heat exchanger 84 can facilitate the exchange of heat between the air 12*a* in the supply conduit 82 and the returning air 12*a*' in a discharge conduit 88. The second heat exchanger can be provided along the supply conduit downstream of the first heat exchanger 84. The second heat exchanger can be almost any type of heat exchanger, but it is preferred if the second heat exchanger is a fin-fan cooler 90. The second heat exchanger can be used to further reduce the temperature of the gas 12*a*, such as below the dew point. Thus, the gas 12*a* can release a portion of its humidity as liquid water. The separator 86 can be placed downstream of the second heat exchanger to extract the condensed water from the gas 12*a*. The previous discussion regarding separator 20 in connection with the first system 10 is equally applicable to separator 86. Water 94 can be collected and can flow from the separator 86 to a process user or a storage device. In one embodiment, a conduit 92 can be in fluid communication with the separator 86 for transporting the collected water 94 to a storage tank 96 or elsewhere.

A discharge conduit 98 can extend from the separator 86 and connect back into the exhaust duct 14. A blower 100 can be provided along the discharge conduit 98. The blower 100 can increase the pressure of the gas 12*a*' to help route the gas back to the exhaust duct 14. Ideally, the blower 100 is located along the discharge conduit 98 at or near where the gas 12*a*' is coldest. For example, the blower 100 can be located just downstream of the separator 86.

The discharge conduit 98 can be configured to pass through the first heat exchanger 84. Thus, the gas 12*a*' in the discharge conduit 98 can pass in heat exchanging relation with the gas 12*a* in the supply conduit 82. Thus, it will be appreciated that the relatively cool gas 12*a*' in the discharge conduit 98 can be used to reduce the temperature of the relatively hot gas 12*a* in the supply conduit 82. This reduction in the temperature of the gas 12*a* can reduce the duty of the heat exchanger. After passing the first heat exchanger 84, the gas 12*a*' can reenter the exhaust duct 14 for discharge to the atmosphere.

Any of the above water recovery systems can be used to extract water from the turbine exhaust gases. The recovered water can be used for any of a number of purposes. For instance, the water can be injected into the compressor section of the engine, such as at the inlet, to improve power and efficiency through wet compression. Alternatively or in addition, improved cooling can be achieved by injecting the water into the rotor cooling air circuit. The water can be routed to a cooling tower or can be used as drinking water. It will be appreciated that there are a wide range of possible uses for the recovered water. Further, it will be appreciated that aspects of the invention can expand the geographic possibilities for selecting a power plant site. A power plant having a water recovery system according to aspects of the invention can minimize or eliminate dependence on surface, well or municipal water sources. In addition, such a power plant may not require a permit for withdrawing the water from the environment.

The foregoing description is provided in the context of various possible water recovery systems. It will of course be understood that the invention is not limited to the specific details described herein, which are given by way of example only, and that various modifications and alterations are possible within the scope of the invention as defined in the following claims.

What is claimed is:

1. A water recovery system comprising:

an exhaust duct with a turbine exhaust gas flowing therein, the turbine exhaust gas including water vapor and being at a first temperature;

an absorption chiller;

a supply conduit extending between and in fluid communication with the exhaust duct and the absorption chiller, wherein the supply conduit receives a portion of the turbine exhaust gas and routes the gas to the absorption chiller, wherein the absorption chiller reduces the temperature of the turbine exhaust gas to less than the dew point of the gas, thereby causing at least some of the water vapor in the turbine exhaust gas to condense; and a separator operatively associated with the absorption chiller, wherein the separator removes at least a portion of the condensed water from the exhaust gas.

2. The system of claim 1 wherein the absorption chiller is primarily powered by the heat energy of the exhaust gas in the exhaust duct.

3. The system of claim 1 further including a discharge conduit extending from and in fluid communication with the absorption chiller, wherein the discharge conduit routes the gas out of the absorption chiller.

4. The system of claim 3 wherein the discharge conduit is in fluid communication with the exhaust duct, whereby the gas is returned to the exhaust duct.

5. The system of claim 3 further including a blower provided along the discharge conduit, whereby the blower facilitates the movement of the gas along the discharge conduit.

6. The system of claim 3 further including a heat exchanger, wherein the supply conduit and the discharge conduit pass in heat exchanging relation through the heat exchanger such that the temperature of the gas in the supply conduit is reduced prior to entering the absorption chiller, whereby the effective duty of the absorption chiller is reduced.

7. A water recovery system comprising:

an exhaust duct with a turbine exhaust gas flowing therein, the turbine exhaust gas including water vapor and being at a first temperature;

a direct contact heat exchanger having an inlet and an outlet, each of the inlet and the outlet being in fluid communication with the exhaust duct, a portion of the turbine exhaust gas being received in the inlet, the direct contact heat exchanger having an upper end and a lower end, wherein the lower end is defined at least in part by a sump; and at least one water dispensing device provided in the direct contact heat exchanger near the upper end, the at least one water dispensing device being adapted to introduce water into the flow of the turbine exhaust gas, wherein the water engages the exhaust gas so as to reduce the temperature of the exhaust gas so as to condense at least a portion of the water vapor in the exhaust gas, wherein the water collects in the sump.

8. The system of claim 7 wherein the direct contact heat exchanger is substantially vertical, wherein the outlet is provided vertically higher than the inlet.

9. The system of claim 7 further including a damper operatively associated with the outlet of the direct contact heat exchanger, wherein the damper can selectively regulate the flow of the gas through the outlet.

10. The system of claim 7 further including:

a return conduit in fluid communication with the sump and the at least one water dispensing device, wherein the return conduit routes water from the sump to the at least one water dispensing device for introduction to the turbine exhaust gas in the direct contact heat exchanger; and a heat exchanger provided along the return conduit for reducing the temperature of the water to no more than about the ambient dry bulb temperature.

11. The system of claim 10 wherein the heat exchanger is a fin-fan cooler.

12. The system of claim 10 further including a pump provided along the return conduit, whereby the pump facilitates the flow of water through the return conduit.

13. The system of claim 10 wherein the return conduit includes a branch conduit, wherein the branch conduit is located upstream of the heat exchanger, whereby water can flow into the branch conduit for use elsewhere.

14. The system of claim 13 wherein the branch conduit is in fluid communication with a storage tank, whereby water is stored therein for later use.

15. The system of claim 13 further including a control valve provided along the branch conduit, wherein the control valve selectively permits and prohibits flow of the water through the branch conduit.

16. The system of claim 15 further including a sensor for activating and deactivating the valve, wherein the sensor is connected to the sump so as to be responsive to the level of the water in the sump, and wherein the sensor is operatively associated with the control valve such that the sensor activates the control valve when the level of the water in the sump reaches a predetermined level.

17. A stack water recovery system comprising:

an exhaust duct with a turbine exhaust gas flowing therein, the turbine exhaust gas including water vapor and being at a first temperature;

a separator;

a supply conduit extending between and in fluid communication with the exhaust duct and the separator, wherein the supply conduit receives a portion of the turbine exhaust gas and routes the gas to the separator;

a discharge conduit extending between and in fluid communication with the separator and the exhaust duct, wherein the gas in the discharge conduit reenters the exhaust duct for release into the atmosphere;

a first heat exchanger provided along the supply conduit upstream of the separator, wherein the supply conduit and the discharge conduit pass in heat exchanging relation through the first heat exchanger, and wherein the first heat exchanger reduces the temperature of the exhaust gas in the supply conduit below the first temperature; and a second heat exchanger provided along the supply conduit downstream of the first heat exchanger and upstream of the separator, wherein the second heat exchanger further reduces the temperature of the turbine exhaust gas to a temperature below the dew point of the gas, thereby causing at least some of the water vapor in the turbine exhaust gas to condense, wherein the separator removes at least a portion of the condensed water from the gas.

18. The system of claim 17 wherein the second heat exchanger is a fin-fan cooler.

19. The system of claim 17 further including:

a storage tank; and a conduit extending between and in fluid communication with the separator and the storage tank, wherein the water is routed to the storage tank for later use.

20. The system of claim 17 further including a blower provided along the discharge conduit.

* * * * *